United States Patent [19]

Nutter

[11] 4,411,295

[45] Oct. 25, 1983

[54] DEVICE FOR EQUALLY FILLING A PLURALITY OF CONTAINERS

[76] Inventor: Steven D. Nutter, #4 Cederedge Manor, Imperial, Mo. 63052

[21] Appl. No.: 287,284

[22] Filed: Jul. 27, 1981

[51] Int. Cl.[3] ..... B65B 31/00; B65B 37/18

[52] U.S. Cl. ..... 141/59; 141/94; 141/192; 141/231; 141/237

[58] Field of Search ..... 141/9, 59, 83, 94, 192, 141/196, 231, 232, 237, 238, 242, 243, 284, 285, 367

[56] References Cited

U.S. PATENT DOCUMENTS

| | | | |
|---|---|---|---|
| Re. 11,300 | 1/1893 | Donally | 141/243 |
| 858,051 | 6/1907 | Allen | 141/242 |
| 1,005,984 | 10/1911 | Lealand | 141/231 |
| 4,059,134 | 11/1977 | Violette | 141/242 |

*Primary Examiner*—Stephen Marcus
*Assistant Examiner*—Kenneth S. Putnam
*Attorney, Agent, or Firm*—Haverstock, Garrett & Roberts

[57] ABSTRACT

A device for equally filling a plurality of containers including a primary distributor disc having a top inlet and a plurality of bottom outlets equally spaced from the top inlet and equally spaced around the primary distributor disc, a plurality of secondary distributor discs, each having a top inlet and a plurality of bottom outlets equally spaced from the secondary distributor disc top inlets and equally around the secondary distributor discs, a plurality of equal fluid conducting pipes, one for connecting each of the outlets of the primary distributor discs to the inlet of one of the secondary distributor discs, and a filler hose connected to each of the outlets of the secondary distributor discs and extending downwardly to one of the containers of the plurality of containers. An electrically controlled valve actuatable by a weight controlled device which generates an electric signal when a selected one of the containers is full may be used to block the flow of fluid to the plurality of containers when the containers reach the desired fullness. One embodiment is provided wherein the device is used with a plurality of fluid sources, and another embodiment is provided wherein the device is usable to empty a plurality of containers. The device may include a fume evacuating system for disposing of fumes while the containers are being filled.

13 Claims, 10 Drawing Figures

FIG. 5
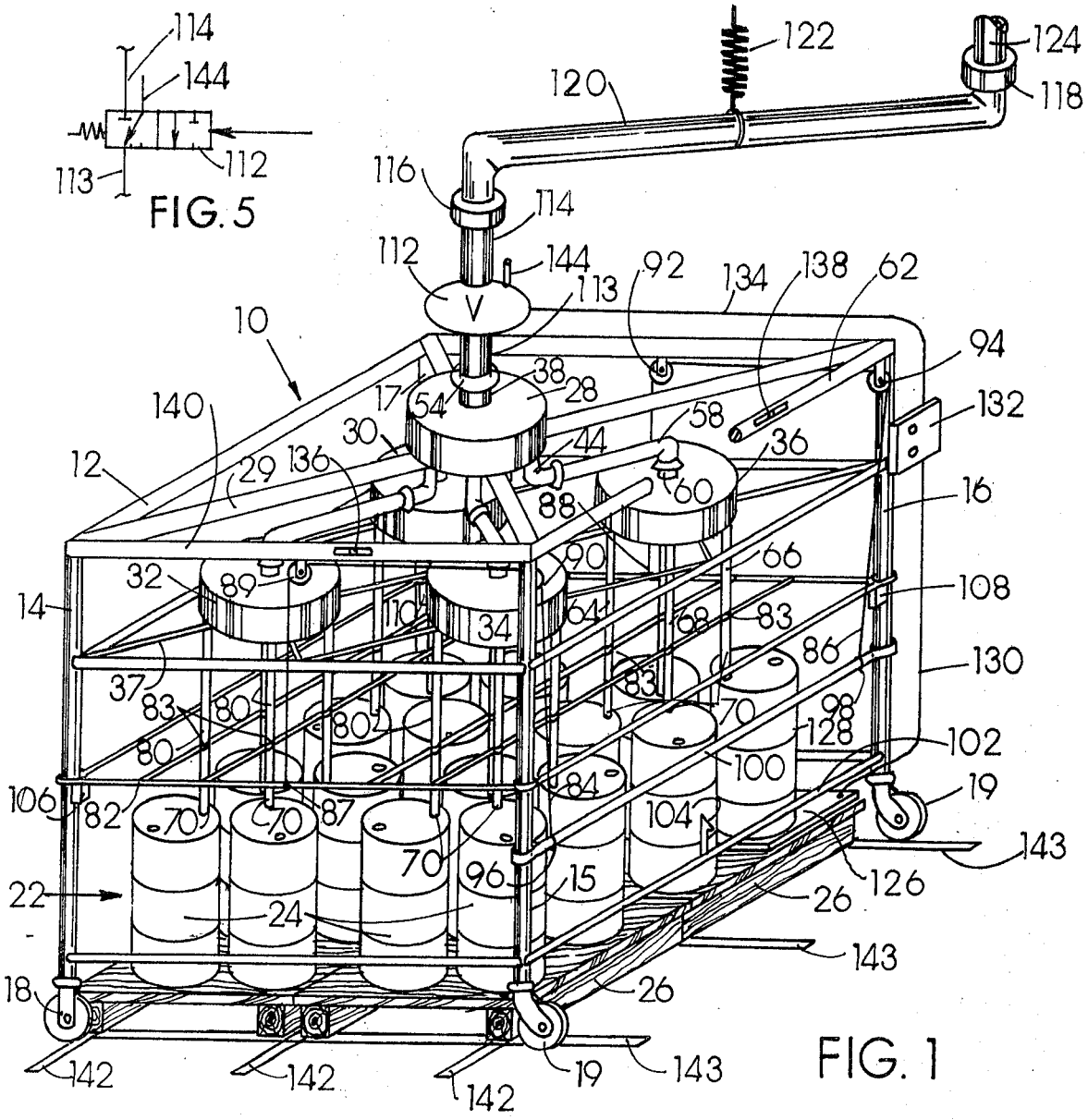
FIG. 1
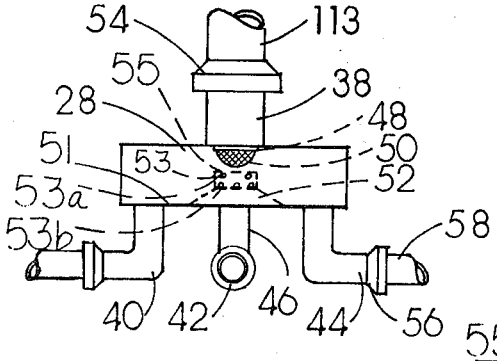
FIG. 2
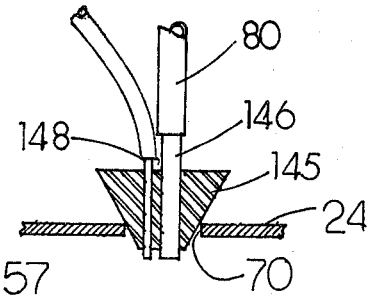
FIG. 6
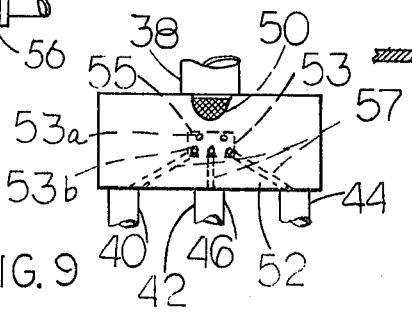
FIG. 9

DEVICE FOR EQUALLY FILLING A PLURALITY OF CONTAINERS

The present invention relates to a device for equally filling a plurality of containers with a fluid by gravity feed from a common source.

Many devices are in existence for filling a plurality of containers for various reasons and with various fluids from a common source. Many of these devices include a pressurized source of fluid wherein the fluid is fed to a manifold system connected to a plurality of feeder pipes of equal diameter with one feeder pipe for each container to be filled. In these devices, the pressure in each feeder pipe is equal so that the fluid delivered by each feeder pipe is equal. These devices, however, are not applicable to gravity feed systems because in a gravity feed system the pressure is not always equal and the feeder pipe closest to the source of fluid will receive more fluid than those further from the source resulting in the containers being filled at different filling rates and therefore unequally. In some of the prior art gravity feed systems, a separate valve is provided for each feeder pipe filling a container such that as each individual container becomes full, the valve shuts. In many gravity feed devices where the equal filling of the containers is not important, no provision is made to ensure that all containers are filled equally.

The present device is made up of a main distributor disc for receiving fluid from a source and is connected to a number of secondary discs, each for filling a plurality of drums or containers. All of the outlets of the main distributor disc are as identical as possible as are all of the outlets of the secondary distributor discs, and all of the secondary distributor discs are located at the same elevation and the same distance from the primary distributor disc. All of the distributor discs are also leveled, and each distributor has its outlet directed to discharge into either a plurality of subordinate distributor discs or into a plurality of containers to be filled. The distributor discs should be higher than the containers or distributor discs to be filled therefrom. The pattern may be duplicated depending upon the number of containers to be filled. It is important if more than one distributor disc is used, that they all be leveled and that all the outlet fittings and connections be the same since the whole system depends on the same flow to each container.

Prior art devices that have been considered and are of general interest to show the state-of-the-art are disclosed in U.S. Pat. Nos. 942,271; 1,416,126; 1,987,580; 2,055,704; 2,719,496; 2,791,353; 2,872,953; 3,196,909; and 3,893,494.

It is therefore a principal object of the present invention to teach the construction and operation of improved means for equally filling a plurality of containers.

It is another object to teach the construction of a gravity feed device for equally filling a plurality of containers.

It is another object to teach the construction of a filling device which is movable to a position over a plurality of containers to be filled and which may be removed when the containers have been filled giving access to the filled containers.

It is another object to teach the construction of a device for filling a plurality of containers with liquid which reduces the time that workers are exposed to fumes from the liquid.

It is another object to teach the construction of a device for filling a plurality of containers with a liquid such as a toxic liquid with minimum exposure of the workers to the toxic fumes.

Another object is to reduce the time and labor required to fill a plurality of containers.

Another object is to provide a relatively simple trouble free gravity feed system for distributing liquid products in bulk storage into a plurality of equal quantities.

It is another object to teach the construction of a device for filling a plurality of containers wherein the fullness of one container is monitored to determine the fullness of all containers being filled.

It is another object to teach the construction of a device for filling a plurality of containers which is inexpensive to make and whose operation and construction is simple.

It is another object to teach the construction of a device for equally filling a plurality of containers which alternatively may be used to empty containers.

These and other objects and advantages of the present device will become apparent after considering the following detailed specification in conjunction with the accompanying drawings wherein:

FIG. 1 is a diagramatic view of one embodiment of a device for use in filling a plurality of containers from a bulk source;

FIG. 2 is a side elevational view of the primary distributor disc of the device of FIG. 1;

FIG. 5 is a schematic diagram of a filler valve for use with the device of FIG. 1;

FIG. 6 is a fragmentary cross-sectional view of a filler tube inserted in a filler hole in a container;

FIG. 9 is a side elevational view of another construction of the distributor discs of the device of FIG. 1; and, FIG. 10 is a fragmentary cross-sectional view of a connection means for connecting a filler tube to a container.

Figure 7:
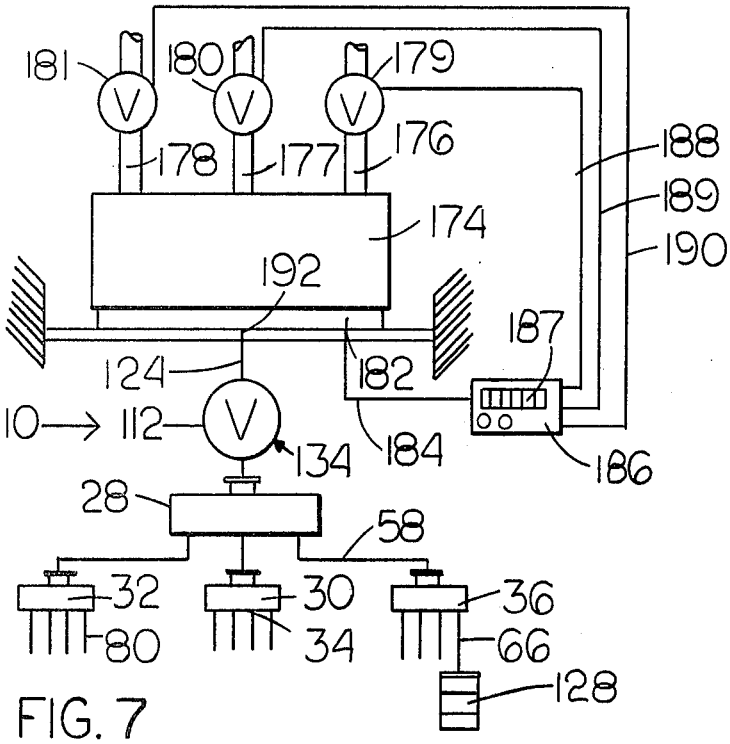
FIG. 7 is a diagramatic view of a delivery system using the device of FIG. 1.

Referring to the drawings more particularly by reference numbers, number 10 in FIG. 1 identifies a device for simultaneously equally filling a plurality of containers. The device 10 includes a frame 12 formed of upright support members 14, 15, 16 and 17 and mounted on wheels 18 and 19 so that the device can be moved from place to place as desired. As shown in FIG. 1, the wheels 18 are in fixed alignment and the wheels 19 are mounted on swivels so that the device including the frame 12 can be guided in its movements. The lower portion on one side of the device designated by reference number 22 is open so that the frame 12 can be rolled into a position over a plurality of containers 24 to be filled. In the drawing, the containers 24 to be filled are shown positioned on pallets 26 which is a convenient way to handle the containers and to arrange them for alignment during filling. Alternately, the frame 12 may be fixed at a stationary location, and pallets having containers located thereon moved through the open side 22 by means such as a fork lift truck and positioned under the device 10 as shown.

The device includes a primary distributor disc 28 shown located at the center of the frame 12 on a rack 29 fastened to the uprights 14–17, and four secondary distributor discs 30, 32, 34 and 36 mounted on a lower rack 37 with the secondary discs 30–36 arranged to be equally spaced angularly and radially to be in a circle centered below the primary distributor disc 28. The primary distributor disc 28 (FIG. 2) communicates with an inlet tube 38 centered in its top, and with four equal size outlet tubes 40, 42, 44 and 46 which are attached to the bottom of the distributor disc 28 at locations equally spaced outwardly from the center of the disc 28 which is directly under the inlet tube 38. The arrangement of the inlet and outlets is important to the invention because it means that when liquid flows into the distributor disc 28 through the inlet 38, it strikes the bottom of the disc and only needs to flow an equal distance to each one of the outlet tubes 40–46 so that the liquid flowing from the inlet 38 into the disc 28 will be evenly distributed to all of the outlets. This is true regardless of the pressure of the liquid flowing into the disc 28.

The inlet tube 38 is shown having an extension 48 which projects downwardly into the disc 28, and the lower end of the extension may optionally include a screen member such as the cup shaped screen member 50 for breaking up the liquid flow as it enters the disc 28 thereby to some extent assisting in the even distribution of the liquid to the outlets 40–46. The floor 51 of the disc 28 may also have a center raised portion 52 onto which the incoming liquid impinges and is directed outwardly. A cylindrical baffle member 53 may be located on the raised portion 52 having a central opening 55 centered under the inlet 38 for catching liquid flowing therefrom, and a plurality of holes 53*a* and bottom notches 53*b* for draining the fluid flowing into the baffle member 53. The baffle member 53 breaks up the liquid flow and reduces any swirling motion in the liquid flow, assisting in the even distribution of the liquid to the outlets. The bottom notches 53*b* are located at the bottom of the baffle member 53 adjacent the raised portion 52 so that the baffle member 53 is completely drained and no liquid is trapped within member 53. As shown in FIG. 9, the raised portion 52 may include grooves 57 which lead from one of the notches 53*b* to one of the outlets 40–46 so that liquid will be equally distributed during periods of very low flow, such as during the starting and stopping of liquid flow into the device 10 or when a small amount of liquid is distributed. Holes 53*a* are provided in the member 53, and the top of the baffle member 53 is spaced from the screened member 50 so that a portion of the liquid during a high liquid flow from inlet 38 will flow out of the holes 53*a* and a portion of the liquid can overflow the baffle device without trapping air in the disc or causing a backup in the inlet 38 which might adversely affect the equal distribution of liquid between the outlets. The inlet tube 38 in the embodiment shown also includes a union 54 for convenience in connecting the inlet 38 to a source of liquid to be distributed.

Each of the outlet tubes 40–46 is shown in FIG. 2 having a right angle turn, and each outlet is connected by a union such as union 56 to a fluid conducting pipe such as pipe 58 which is provided to conduct liquid flowing from the disc 28 to the inlet of the secondary distributor disc such as to one of the secondary discs. For instance, the outlet tube 44 is connected to inlet tube 60 of the secondary distributor disc 36 (FIG. 1). The construction of the secondary distribution disc 36 may be similar to the construction of the disc 28. Rail 62 in the top rack 29 is shown broken away in FIG. 1 to more clearly expose the connection between the primary disc 28 and the secondary disc 36.

The secondary distributor disc 36 has four outlet filler tubes 62, 64, 66 and 68 (FIGS. 3 and 4) equally spaced outwardly from the center of the disc 36 which is centered under the inlet tube 60. The filler tubes 62–68 extend downwardly to be fitted into filler openings 70 of each of the respective containers 24 to be filled.

The fluid conducting pipe 58 and the inlet tube 60 of the disc 36 in the embodiment shown also are connected together for convenience by a union 72, and each of the filler tubes 62–68 in the embodiment shown includes a union 74 for convenient connection to the bottom of the disc 36. The inlet tube 60 is shown having an extension 76 (FIG. 4) which projects downwardly into the disc 36, and the lower end of the extension 76 may optionally include a screen member such as cup shaped screen member 78 for breaking up the flow as it enters the disc 36 as previously described in connection with the primary disc 28. Centered under the inlet 60 is a raised lower wall portion 79 and a cylindrical baffle member 81 similar to the raised portion 52 and baffle member 53 described in connection with the primary disc 28.

Filler tubes 80, including the filler tubes 62–68, extend downwardly from the discs 30–36 and are shown attached to portions of a multi-rod rack 82 at connections 83. The rack 82 slides upwardly and downwardly along the uprights 14–17 of the frame 12 by pulling on cables 84 and 86. The cables 84, 86 have one of their ends 87 and 88 respectively connected to the rack 82 passing over pulleys 89, 90, and 92, 94 respectively and have their other ends 96 and 98 respectively connected to a cross bar 100 which is slidable upwardly and downwardly along the uprights 15 and 16. A fixed crossbar 102 extends between the uprights 15 16 and includes a releasable latch 104 for releasably holding the crossbar 100 when it is moved to its lower position. To raise the rack 82 thereby removing all of the tubes 80 from the holes 70, the crossbar 100 is pushed downwardly pulling the cables 84 and 86 over the respective pulleys. The crossbar 100 is lowered to engage the releasable latch 104 thereby holding the crossbar 100 down and the slidable rack in its upper raised position. To lower the slidable rack 82, the latch 104 is disengaged from slidable crossbar 100, and the crossbar 100 is moved to its upper raised position thereby lowering the rack 82. Stops 106, 108 and 110 are provided on uprights 14, 16 and 17, respectively, and a similar stop (not shown) is provided on upright 15 for limiting the downward travel of the slidable rack 82 at its lower position as shown.

Figure 3:
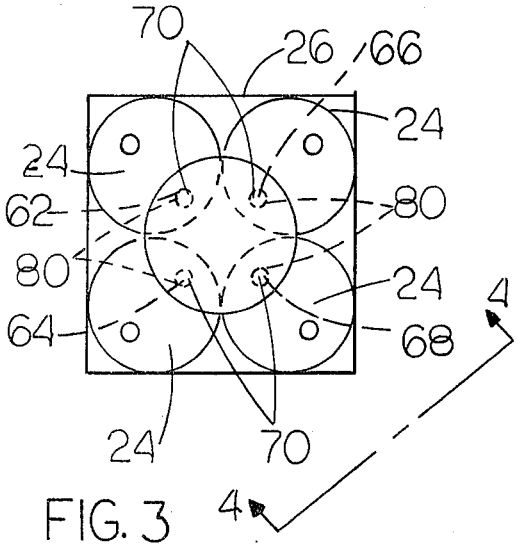
FIG. 3 is a top plan view of one of the secondary distributor disc of the device of FIG. 1, said secondary disc shown being used for filling four containers.

The filler tubes 80 of the secondary distributor discs 30–36 are connected to the slidable rack 82 at 83 so that the ends of the filler tubes 80 will move adjacent the filler holes 70 of the containers 24 when the rack 82 is moved to its lowermost position such that the filler tube 80 may if necessary because of alignment problems be quickly placed by an operator into the filler holes 70. As shown in FIG. 3, the containers 24 to be filled are located on the pallets 26 such that one of the filler holes 70 in each container is under one of the filler tubes 80. If the containers are carefully aligned under the tubes 80, many of the filler tubes will be lowered into the holes 70 when the rack 82 is lowered. The filler tubes 80 are flexible so that they may be repositioned with their ends in the holes 70 as may be required after the rack 82 has been lowered.

An electrically operated two position valve 112 is connected to one end of a fluid conducting pipe 113 which is in turn connected to the inlet tube 38 of the primary filler disc 28 preferrably by the union 54 as previously described. A second pipe 114 is connected to the opposite inlet side of the valve 112 for supplying liquid to the valve 112 for distribution by the device 10 to the containers 24. The inlet end of the pipe 114 is connected to a swivel connector 116 which is connected to another swivel connector 118 by pipe 120. The pipe 120 may optionally be supported by hanger means 122 which enables it and the pipe 120 to move to facilitate locating the device over the containers to be filled. The swivel connector 118 is connected to inlet pipe means 124 whose other end is connected to a source of fluid to be distributed by the present device.

A weight actuated electric control 126 is positioned under one of the drums 128 of the plurality of drums 24 and is connected by a lead 130 to a control box 132. The control box 132 is connected to the valve 112 by lead 134 such that the valve 112 is actuatable by controls on the control box 132.

Figure 4:
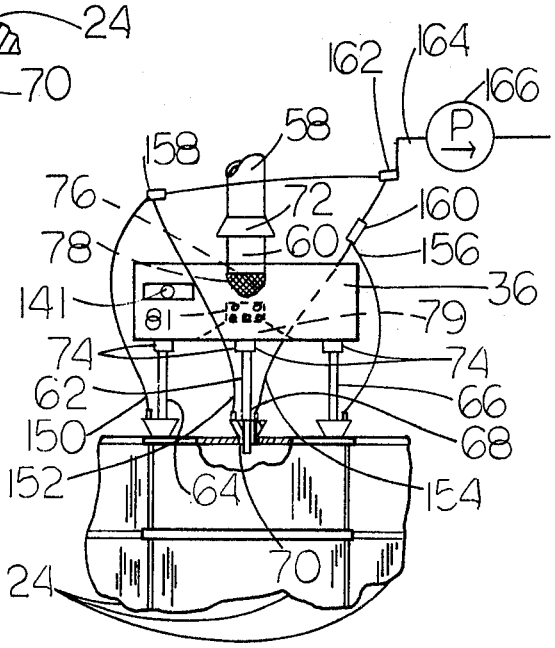
FIG. 4 is a fragmentary side elevational view of the secondary distributor disc of FIG. 3 taken along line 4—4.

Levels 136 and 138 are located on crossbars 140 and 62 of the frame 12, respectively, to assist in leveling the device 10 ensuring that an equal amount of liquid is distributed to each of the containers 24. Levels 141 may optionally also be placed on the distributor discs as shown in FIG. 4.

A grid of lines 142 and 143 may optionally be painted on the floor to indicate the positioning of the pallets 26 on which the plurality of containers 24 are placed. The pallets 26 may be marked, or a template may be used to locate the drums 24 so that the filler holes 70 will be properly positioned under the filler tubes 80 as shown in FIG. 3.

To use the device 10, the frame 12 is rolled to one side on the wheels 18 and 19. The swivels 116 and 118 rotate, allowing the intermediate pipe 120 to pivot and the frame 12 to move relative to the grid of lines 142 and 143 painted on the floor. A flexible hose could be used in place of or in connection with the swivels 116 and 118, if desired.

The pallets 26 are placed in position as indicated by the lines 142 and 143, and a plurality of empty containers 24 are positioned on the pallets with their filler holes 70 oriented to be under the filler tubes 80 of the secondary distributor discs 30–36. The frame 12 is then rolled into position with the containers 24 on the pallets 26 passing through the opening 22 until the frame 12 is centered over the plurality of containers 24, as shown. The movable crossbar 100 is released from latch 104 and moved upwardly, lowering the sliding rack 82 to its lowermost position on the stops 106–110. The lowering of the rack 82 lowers the filler tubes 80 extending downwardly from the secondary distributor discs 30–36 until the ends of the filler tubes either move adjacent or, if the containers are properly aligned under the secondary discs, into the filler holes 70. Any filler tubes 80 which have not been lowered into a hole 70 is repositioned so that its end is in a filler hole 70 of a respective container 24.

The weight operated electric control 126 is placed under the container 128 and the filler valve 112 is opened by controls on the control box 132. Liquid then flows from a bulk source (not shown) through pipes 124, 120, 114, and 113 into the primary distributor disc 28, and from there into the secondary discs 30–36 and into each of the containers 24 through the filler tubes 80 as described. When the container 128 is nearly full, the weight operated control 126 is activated turning off the electrically operated valve 112 shuting off the flow of liquid. The weight operated control 126 is adjusted to turn off the valve 112 just before the container 128 is full so that liquid remaining in the distributor discs 30–36 and the connecting pipes completely drains into the containers 24. The valve 112 is a two position valve (FIG. 5) which, when in the closed position, opens a vent 144 allowing liquid in the device 10 to drain and when in the opened position, closes the vent 144 and opens the pipe 114 allowing liquid to flow into the device 10. The vent 144 permits the device 10 to completely drain after each use, minimizing the mixing of liquid from one use of the device 10 to the next in order that different liquid products from different bulk sources may be used, if desired.

FIG. 6 shows one embodiment of the end of one of the filler tubes 80 terminating in a conical stopper 145 sized such that its smaller end fits into the filler opening 70 of one of the containers 24. The conical stopper 145 has a filler tube 146 extending therethrough for connection to one of the filler tubes 80, and a smaller vacuum tube 148 therethrough for evacuating fumes from the interior of the container 24 when the stopper 145 is in place. The vacuum tube 148 is connected to one of vacuum lines 150–156 shown in FIG. 4, with vacuum lines 150 and 152 connected by a Y-connector 158 and vacuum lines 154 and 156 connnected by a Y-connector 160. The Y-connectors 158 and 160 are in turn connected by another Y-connector 162 which is connected to a vacuum line 164 leading to a vacuum pump 166. When the containers 24 are being filled with a liquid having toxic fumes, the vacuum pump 166 is turned on drawing the fumes from the container and returning them to a storage tank or otherwise safely disposing of them, eliminating the hazard of workers breathing the fumes while the drums are being filled. Similar vacuum lines from the filler tubes of the other secondary distributor discs may also be connected to the vacuum pump 166 by appropriate connections.

Figure 10:
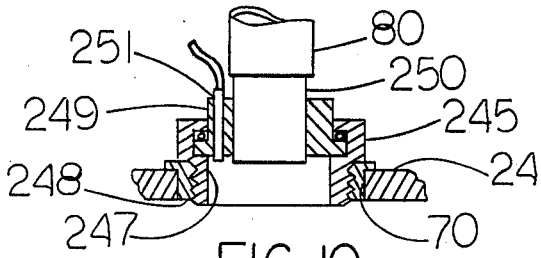

Instead of the embodiment shown in FIG. 6, the filler tube 80 may terminate in a connection means 245 shown in FIG. 10 wherein the connection means 245 has a threaded portion 247 for threaded engagement with a bung receptacle 248 located in the filler hole 70. The connection means 245 include a rotatable portion 249 having a connection 250 for the filler tube 80 and a vacuum hose connection 251, and arranged such that the threaded portion 247 may be screwed into engagement with the receptacle 248 without turning the filler tube 80. In one use of this embodiment, the secondary discs 30–36 are separated from the device 10 by disconnecting unions 72. The discs 30–36 are each located above a group of four containers on a pallet as shown in FIG. 3 by engaging the threaded portions 247 of the connection means 245 with bung receptacles in the filler holes 70 of the containers 24. The containers and the pallets are then positioned in the arrangement shown in FIG. 1, and the device 10 is rolled in position over the containers, and the unions 72 are reconnected. The plurality of containers 24 is then filled, as previously described.

Since the flow area through a tube varies as the square of the inside diameter of the tube, the pipes leading from the primary distributor disc 28 to the secondary distributor discs 30–36 may be designed to have twice the diameter as the filler tubes 80 leading from the secondary distributor disc 30–36 to the containers 24 to be filled. Similarly, the pipes 113, 114, 120 and 124 can be designed to have twice the diameter of the pipes between the disc 28 and the discs 30–36. When designed in this matter, the velocity of the liquid flow through all of the pipes in the system will be equal. If the device 10 is used to fill sixteen drums, the time needed to fill all of the drums will be the same as the time needed to fill one drum from a one inch filler tube if the filler tubes 80 are one inch tubes, the pipes connecting the primary filler disc 28 to the secondary filler discs 30–36 are two inch pipes and the pipes 113, 114, 120 and 124 are four inch pipes. However, the sizes of the pipes in the system are not essential in the construction of the device 10. If the diameters of the pipes are reduced, the time needed to fill the plurality of drums will be increased.

FIG. 7 shows an embodiment for premeasuring the amount of liquid to be distributed from one of a number of separate bulk sources. A filling tank 174 is arranged to be filled by a number of sources 176, 177 and 178 each of which is controlled by an electrically operated valve 179, 180 and 181, respectively. The contents of the tank 174 is measured by a weight activated electric control 182 which is connected by an electrical lead 184 to control and monitor device 186 for reading out the weight or volume of the contents of the tank 174. The device 186 is connected by leads 188, 189, and 190 to valves 179, 180 and 181, respectively. The outlet 192 of tank 174 is connected to the inlet pipe 124 of the device 10.

To fill the plurality of containers 24 with one of the liquids from one of the sources 176–178, the proper valve 179–181 is opened by a signal from the device 186 over the corresponding electric lead 188–190. When readout 187 associated with the device 186 indicates that the tank 174 holds the proper amount of liquid to fill the plurality of containers, the valve 179–181 is closed, and the valve 112 is opened by a signal over electric lead 134, allowing the contents of the tank 174 to drain through the device 10 into the plurality of containers 24 as previously described. After the tank 174 and the device 10 has been completely drained, the valve 112 is closed and the device may be used to fill another plurality of containers from any one of the sources 176–178 as previously described.

The number of containers in the plurality of containers can be varied by varying the number of distributor discs used, and by varying the number of outputs from each disc as long as each disc contains the same number of outlets, the pipes connecting the primary disc to the secondary disc are of the same diameter and the same length, and the distances between the inlet and each of the outlets in the distributor discs and equal.

Figure 8:
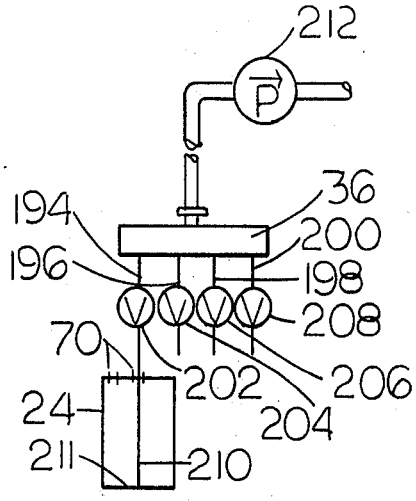
FIG. 8 is a side elevational view of an embodiment of the subject device for use in emptying a plurality of containers.

FIG. 8 shows an embodiment wherein the device 10 may be used to empty containers. In this embodiment, the tubes 194–200 each have valves 202–208, respectively. Each valve, as for example valve 202, is connected to tubular extensions 210 of sufficient length to extend through one of the holes 70 in the one of the containers 24 to near the bottom 211 of the container. A vacuum pump 212 is connected to the device 10 and may be actuated to draw liquid out of the plurality of containers in the reverse direction of that previously described. As a container becomes empty, its corresponding valve 202–208 is closed so that the suction from the pump 212 is not lost. As each container is emptied, its valve is closed until all of the containers are empty. This embodiment allows a plurality of containers having varying amounts of liquid therein or containers of different sizes to be emptied at one time in the reverse direction through the device 10.

Thus, there has been shown and described several embodiments of a novel device for equally filling or emptying a plurality of containers which fulfill all of the objects and advantages sought therefor. It will be apparent to those skilled in the art, however, that many changes, modifications, variations and other uses and applications of the subject device are possible. All such changes, modifications, variations and other uses and applications which do not depart from the spirit and scope of the invention are deemed to be covered by the invention which is limited only by the claims which follow.

What is claimed is:

1. A device for simultaneously equally filling a plurality of containers from a common source of fluid comprising a primary distributor including a top member having an inlet port positioned centrally thereon for connection to a source of fluid and a bottom member spaced from said top member, said bottom member having a plurality of equally angularly spaced outlet ports each also spaced an equal distance from said central inlet port, first conduit means communicating said inlet port with said common source of fluid, said first conduit means being positioned such that fluid will flow into said primary distributor in a direction substantially equally angularly related to each of said primary outlet ports, a plurality of secondary distributors located in a plane spaced below and parallel to the outlet ports of said primary distributor, each of said secondary distributors including a top member having an inlet port positioned centrally thereon and a bottom member spaced from said top member, each of the bottom members associated with said secondary distributors having a plurality of outlet ports equally spaced both angularly and radially from the inlet port associated with the top member of each respective secondary distributor, second fluid conduits connecting each of the plurality of the outlet ports of said primary distributor to respective ones of the inlet ports associated with said secondary distributors, said second fluid conduits being of equal length and size and each being connected to respective ones of the inlet ports of said secondary distributors such that fluid will flow from said second fluid conduits into said secondary distributors in a direction substantially equally angulary related to each of the outlet ports of said secondary distributors, and third fluid conduits each having one end portion thereof connected to respective ones of the outlet ports of said secondary distributors for conducting fluid from each of said secondary distributor outlet ports into a respective container to be filled therefrom.

2. The device of claim 1 including a wheel frame assembly supporting said primary distributor and said secondary distributors for movement.

3. The device of claim 2 wherein said wheel frame assembly includes adjustable means connected to said third fluid conduits, said adjustable means being movable between a first position wherein said third fluid conduits are positioned for conducting fluid into respective ones of said containers and a second position wherein said third fluid conduits are removed from said containers.

4. The device of claim 1 including weight actuated means responsive to a predetermined amount by weight of fluid in a selected one of the containers to be filled, signal generating means operatively connected to said weight actuated means, and valve means for controlling fluid flow through the inlet port of said primary distributor from said common fluid source, said valve means being operatively connected to said signal generating means and being responsive to generation of a signal therefrom to close said valve means.

5. The device of claim 4 wherein said valve means include a vent operable to open said primary distributor to the atmosphere when said valve is closed.

6. The device of claim 1 including apparatus leveling means attached to the device in position to indicate when the primary and secondary distributors are in a level position.

7. The device of claim 1 including evacuation means operatively connected to each of the secondary distributor outlet ports in position to evacuate fumes from the interior of said plurality of containers as they are filled.

8. The device of claim 7 wherein said evacuation means includes a vacuum line associated with each of said containers, and a vacuum pump operatively associated with said plurality of vacuum lines for drawing fumes from each respective container.

9. The device of claim 1 wherein the bottom member associated with each of said primary and secondary distributors includes deflector means adaptable for assisting in the even distribution of fluid to the outlet ports associated respectively therewith, said deflector means being positioned in alignment with the associated inlet port such that incoming fluid will impinge upon said deflector means and be directly equally towards said respective outlet ports.

10. The device of claim 9 wherein said deflector means includes a centrally raised portion on said bottom member.

11. The device of claim 10 including a cylindrical sleeve member mounted on the raised portion of said bottom member, said sleeve member having a bore therethrough whose longitudinal axis is centered under said inlet port, said sleeve member including a plurality of spaced ports located therearound.

12. The device of claim 11 wherein said raised portion includes a plurality of similar grooves, each groove communicating one of the ports in said sleeve member with one of the respective outlet ports.

13. A device for simultaneously equally filing a plurality of vessels from a common source of fluid comprising a container having a top wall with a centrally located inlet port and conduit means communicating the inlet port to the source of fluid, said conduit means being connected to said inlet port such that fluid will flow into said container in a substantially vertical direction, said container having a closed side wall and a bottom wall spaced parallel to said top wall, said bottom wall having a plurality of outlet ports located equidistant from the inlet port and at equally spaced intervals around said bottom wall, means forming a similar flow path operatively connected to each of said outlet ports for communicating each of said outlet ports to one of the vessels to be filled, each flow path means including a secondary container having a top wall with a centrally located inlet port and conduit means communicating the secondary container inlet port to one of the aforementioned outlet ports, each of said conduit means being of equal length and size and each being connected to one of the secondary container inlet ports such that fluid will flow into said secondary containers in a substantially vertical direction, each of said secondary containers having a closed side wall and a bottom wall spaced parallel to said top wall, said bottom wall having a plurality of outlet ports located equidistant from the secondary container inlet port and arranged at equally spaced intervals around said bottom wall, and a flow tube operatively connected to each of the secondary container outlet ports for communicating each of said secondary container outlet ports to a vessel to be filled.

* * * * *